United States Patent [19]

Huettemann

[11] 4,150,175

[45] Apr. 17, 1979

[54] BUILDING PANEL AND METHOD OF CONSTRUCTION THEREOF

[76] Inventor: Erik W. Huettemann, 15 Mill Rd., Madison, Ala. 35758

[21] Appl. No.: 795,010

[22] Filed: May 9, 1977

Related U.S. Application Data

[63] Continuation-in-part of Ser. No. 669,189, Mar. 22, 1976, abandoned.

[51] Int. Cl.[2] ..... E04C 2/36

[52] U.S. Cl. ..... 427/209; 52/806; 264/46.6; 427/403; 427/427

[58] Field of Search ..... 52/612, 618, 405, 576, 52/577, 806, 808; 428/116; 156/71; 264/259; 427/403, 209, 427

[56] References Cited

U.S. PATENT DOCUMENTS

| | | | |
|---|---|---|---|
| 2,192,182 | 3/1940 | Deutsch | 52/577 |
| 2,262,899 | 11/1941 | Mechlin | 52/405 |
| 2,575,758 | 11/1951 | Herd | 52/618 |
| 3,103,042 | 9/1963 | Martin | 52/615 |
| 3,211,253 | 10/1965 | Gonzalez | 428/116 |
| 3,857,217 | 12/1974 | Reps | 52/576 |
| 3,990,936 | 11/1976 | Geschwender | 428/116 |
| 4,054,477 | 10/1977 | Curran | 156/197 |

FOREIGN PATENT DOCUMENTS

| | | | |
|---|---|---|---|
| 810809 | 3/1959 | United Kingdom | 428/116 |

*Primary Examiner*—John E. Murtagh
*Attorney, Agent, or Firm*—C. A. Phillips

[57] ABSTRACT

A building panel in which two sprayed concrete layers, one on top of the other, are affixed to a paper base honeycomb core. The inner layer on each side comprises concrete without fibers, and the outer layer on each side comprises concrete with 4% to 6%, by weight, of fiberglass fibers.

1 Claim, 7 Drawing Figures

BUILDING PANEL AND METHOD OF CONSTRUCTION THEREOF

This application is a continuation-in-part of application Ser. No. 669,189, filed Mar. 22, 1976, now abandoned.

BACKGROUND OF THE INVENTION

1. Field of the Invention

This invention relates to building panels, and particularly to new and improved building panels wherein thin, strong, concrete coatings are affixed to a honeycomb core.

2. General Description of the Prior Art

Heretofore, substantial efforts have been made to successfully combine the lightweight but strength-giving features of a honeycomb core, particularly a paper honeycomb core, with various cement mixtures as outer coatings or layers. Additionally, in an effort to make coatings stronger and resistant to cracks by shrinkage, it has been suggested that small quantities, approximately 2%, of fibers be added to the cement. Up to this quantity of fibers, it was apparently thought possible to effect the needed penetration of the core, and at the same time not have an excessive amount of liquid content to prevent a dry, unworkable mixture. It does not appear, however, that such percentage is really adequate to do the job, nor does it appear, generally, that any of the prior efforts have resulted in the fabrication of a honeycomb cored panel with a sufficiently thin, durable, and cheap cement coating to achieve any significant market acceptance.

It is the object of this invention to solve the existing problems of honeycomb-concrete panels, and to provide a construction panel which is strong, light, and essentially crackproof. It is a further object of this invention to eliminate from the concrete costly resins and elements such as gypsum which do not weather well. It is a still further object of this invention to provide cheap masonry as a coating wherein there is achieved both the needed penetration of the core, while at the same time avoiding the use of excessive moisture and achieving a higher degree of strength and freedom from cracking than previously experienced.

SUMMARY OF THE INVENTION

In accordance with this invention, a sprayed layer of $\frac{1}{8}$ to $\frac{3}{8}$ inch of concrete in thickness forms an inner layer for each side of a honeycomb core, and a sprayed layer of concrete with 4% to 6%, by weight, of fibers is provided as an outer layer on each of the inner layers. In one mode of construction, the outer layer is applied to a form, the inner layer applied to the outer layer, and then the core pressed into the inner layer. Where by virtue of the construction steps (to avoid excessive penetration), or otherwise there is a need for an insulating filler, the insulating filler material such as insulating foam or insulating aggregate would be placed in the core prior to the application of one or both of the side coatings.

As a feature of the invention, after the insertion of the insulating material, a vaporproof barrier, as by spraying, would be applied on one or both sides of the honeycomb core panel, thereby preventing moisture from settling into the core during the later process of application of the concrete coatings. By the combination of fiberless and fiber concrete layers, a selected degree of penetration is readily achieved (with the fiberless concrete), and yet substantial strength from cracking is achieved by the fiber concrete layer. Further, by means of the two sprayed layers, optimum, low moisture levels may be employed while achieving an essentially double, 4% to 6%, fiber content to thereby substantially enhance strength and essentially eliminate cracking of the coatings. Further, by virtue of the spraying on of the layers, which is, of course, applied under pressure, an extremely dense and enhanced strength of construction is achieved.

DETAILED DESCRIPTION OF THE DRAWINGS

Figure 1:
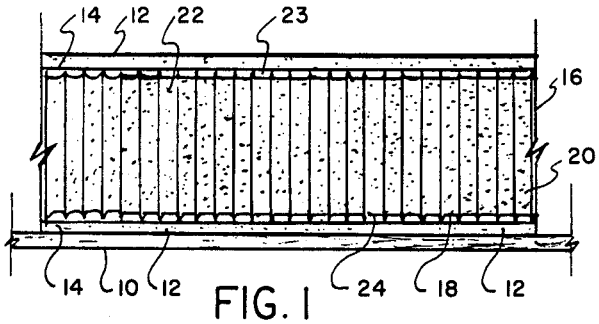
FIG. 1 is a sectional view of a flat panel constructed in accordance with the invention.

Referring to FIG. 1, the panel shown therein is constructed by spraying onto a flat mold 10 a layer 12 of fiber reinforced concrete to a thickness of $\frac{1}{8}$ to $\frac{1}{2}$ inch. This concrete contains 4% to 6%, by weight, of fibers, preferably fiberglass fibers of a length of $\frac{1}{2}$ to $1\frac{1}{2}$ inches in length, and relatively imperviousto the chemical effects of the concrete. Spraying makes possible the relatively high fiber concentration. Next, and before layer 12 cures, a layer 14 of fiberless concrete is sprayed on layer 12, layer 14 being sprayed on to a thickness of $\frac{1}{8}$ to $\frac{1}{4}$ inch. While concrete layer 14 is still molten, paper base honeycomb core 16 is pressed into the interior of layer 14 to a depth of 1/16 to $\frac{1}{4}$ inch. This causes the concrete to adhere to a rather substantial surface layer 18 of cells 20 of the honeycomb and achieves an excellent bond with a minimum of penetration. A greater penetration needlessly increases the overall density of the panel. Slight shrinkage of fiberless layer 14 causes the concrete to tightly grip the honeycomb core. The thickness of the honeycomb core is typically 1 to 12 inches, and the cells of the honeycomb have triangular hexogonal openings of 3/16 to 1 inch square. The core is preferably constructed of an organic material, of which kraft paper is an excellent choice. The sprayed concrete may be either regular concrete with a density of 2.0 to 2.2 (including concrete with a compressive strength of 5,000 to 12,000 PSI), or lightweight concrete (density of 0.8 to 1.2) in any of the layers.

The preceding steps may be repeated to affix a two-layer masonry composition to the other side of the honeycomb core. However, it is preferable, after layers are applied to one side, to fill the open side of the honeycomb core with an insulating material 22, such as foam or lightweight aggregate, up to $\frac{1}{4}$ to $\frac{1}{8}$ inch from the open side surface and then directly spray on the concrete, first spraying on a layer of fiberless concrete to achieve a selected penetration down to the insulation, and then spraying on the fiber concrete. By this means, an extremely good bond of concrete to the honeycomb core is achieved. Alternately, before spraying on the first layer, the fiberless cement on the honeycomb core, a vapor barrier 23 would be sprayed on core 16.

The process just described is somewhat complicated and time-consuming for high production rates, and also does not enable the application of a vapor barrier 24 to the opposite side of the honeycomb core. Thus, as a further feature of this invention, an alternate method has been determined. In accordance with it, the first step would be to place the honeycomb core on a flat level form or cover. Next, the insulating filler material would be placed in the core, and vapor barrier 23 sprayed on as a liquid to the upper surface of the honeycomb core. Next, the vapor barrier would be dried, as by the application of heat. The vapor barrier then forms a film which not only prevents moisture penetration, but also holds the insulating filler material in place. Next, the core is turned over with the bottom form in place, preventing spillage during the turnover. Now, the second side of the core is similarly sprayed, and after it dries, there is achieved the second vapor barrier 24 which additionally prevents insulating filler material from escaping from the second side of the core, and thus the cores can be stored in an upright position and/or readily sprayed in such a position with masonry on both sides. An additional advantage with this latter method is that it becomes feasible to prepare the panels up through the steps of applying the vaporproof coating as one process, then later, perhaps at a second location, to apply the masonry.

Figure 2:
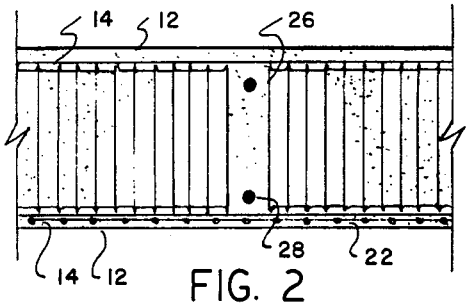
FIG. 2 is a sectional view of a building panel illustrating the addition of various reinforcement means.

FIG. 2 illustrates a panel particularly adapted to load bearing walls or ceilings, and particularly load bearing ceilings with wide spans. For purposes of illustration, various reinforcement means are shown to accomplish this, one or more being usable in a given case. Thus, as one reinforcement means, a wire mesh 24 would be positioned in the bottom layers, typically being put in position between the application of bottom layers 12 and 14. Alternately, or additionally, rips 26 are poured between the masonry surfaces, pouring being with 5,000 PSI-type concrete with prestressed rods 28 included, as shown.

Figure 3:
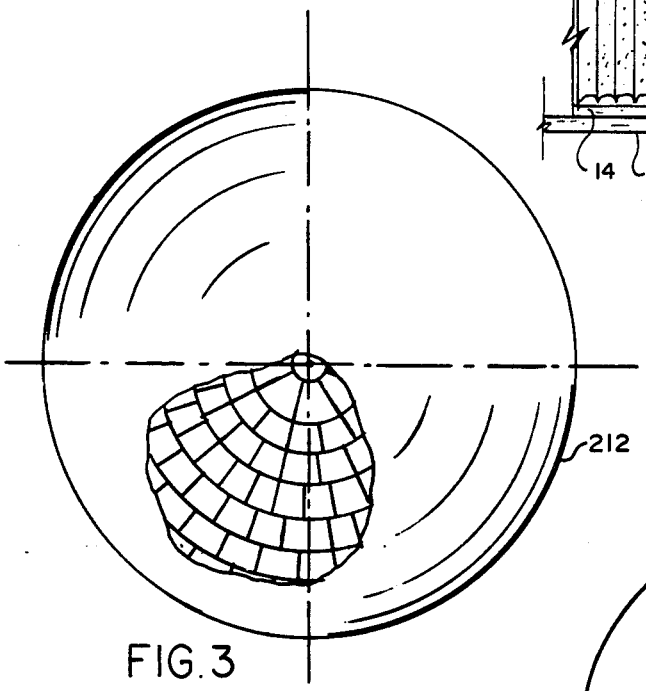
FIGS. 3–5 are schematic illustrations showing the construction of domed or otherwise curved structures fabricated in accordance with the invention.
Figure 5:
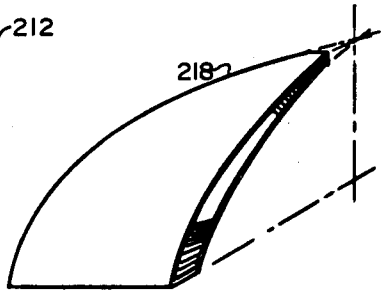
Figure 4:
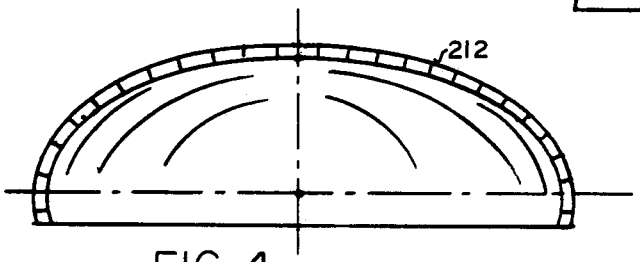

The spraying on of the concrete and fiberous concrete particularly enables the construction of domed and other curved structures illustrated in FIGS. 3–7. FIGS. 3 and 4 particularly illustrate a dome shell 212 in the form of an ellipsoid. Ellipsoid shapes are particularly important structures inasmuch as they are extremely stable forms and particularly resistant to earthquake, high winds, and damage from snow loads. By the construction shown, there is achieved, additionally, a unique combination of strength and insulation. FIG. 5 shows segments 218 of a dome shell which would be used in conjunction with other like segments to form large diameter domes.

Figure 6:
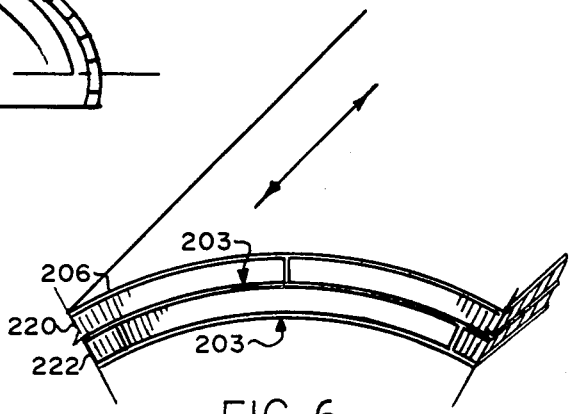
FIG. 6 is a partial perspective view of a cross section of a surved structure wherein dual layers of honeycomb material are employed.
Figure 7:
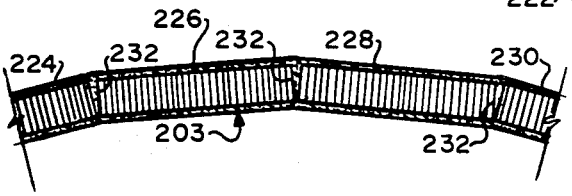
FIG. 7 is a cross sectional view illustrating the formation of a generally curved structure employing a series of plane sections of honeycomb material.

FIG. 5 illustrates the construction of continuous sections of cylindrical, elliptical, or parabolic tunnels, and it takes advantage of the fact that the honeycomb core can be bent in one direction. Since such curved structures are achieved easier with thin layers of honeycomb, several thin layers may be employed. Two layers, 220 and 222, are shown in FIG. 6, the layers being separated by a continuous layer 203 of masonry material (FIG. 2), and a single layer of fiberous cement 206 is placed on top of core 220.

Where it is desired to employ a plurality of basically flat surfaces to achieve trapizoidal or triangular shapes, the core may be segmented as shown in FIG. 7, employing core segments 224, 226, 228, and 230, between which there are rips 232 or closing or wedge-shaped pillar objects, to close the otherwise gap which would appear. As in the case of the embodiment shown in FIG. 2, a top layer 206 and a bottom layer 203 are employed, the latter comprising a bottom layer 200 of fiberous concrete and an upper layer 202 of non-fiberous concrete.

As suggested above, this invention contemplates the employment of a non-metallic honeycomb. More specifically, it contemplates the employment of honeycombs made of organic materials, which would include paper materials and plastic materials. Of these, paper materials are particularly advantangeous inasmuch as these materials are porous. It is a feature of this invention that the concrete provides enhanced gripping of paper because of the porosity. Metals typically are non-porous. Furthermore, metals are quite heat conductive, and thus provide poor insulating characteristics, an undesirable feature for building panels.

From the foregoing, it will be appreciated that the applicant has determined an improved construction panel employing only honeycomb, concrete and fibers in the construction of a panel. By the construction steps outlined and the resulting combination of layers, quite large panels may be constructed without steel reinforcements, e.g,, 10 feet high by 24 to 48 feet in length, and with a thickness of 6 to 8 inches. In fact, much longer lengths, e.g., lengths of 200 feet of continuous wall panels, can be fabricated in one run and later be cut to sizes needed, and with doors and windows cut out to an individual customer's requirement. However, where some additional strength is needed, it is a simple technique to use one or more of the reinforcement means described.

What is claimed is:

1. The method of construction of a building panel comprising:

applying first and second layers of concrete, each layer being $\frac{1}{8}$ to $\frac{1}{2}$ inch in thickness on each side of a sheet of honeycomb core, said sheet of honeycomb core having a plurality of cells having openings on each side of said sheet, and wherein:

said layers are formed by spraying, said first layer is applied to said core and extends therein $\frac{1}{8}$ to $\frac{1}{4}$ inch, said second layer is on and separated from said core by said first layer, said second layer comprises concrete having 4% to 6% of loose fibers, by weight, and said first and second layers are formed by spraying on one layer to the other layer before the said other layer has cured;

placing in the cells of said core an insulating material prior to the application of said layers to both sides of said core; and applying a dryable liquid vapor barrier coating over at least one side of said sheet of honeycomb core before the application of layers to that side of said sheet of honeycomb core and after the placing of said insulating material in said cells of said core, and whereby said interior of said honeycomb core is sealed against moisture, and said insulating material is held in place by said coating after said coating has dried.

* * * * *